US010176676B2

(12) United States Patent
Wallace

(10) Patent No.: US 10,176,676 B2
(45) Date of Patent: Jan. 8, 2019

(54) ORGANIC LIGHT EMITTING DIODE ("OLED") DISPLAY WITH QUICK SERVICE TERMINAL ("QST") FUNCTIONALITY

(71) Applicant: Bank of America Corporation, Charlotte, NC (US)

(72) Inventor: Tammy L. Wallace, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 0 days.

(21) Appl. No.: 15/273,807

(22) Filed: Sep. 23, 2016

(65) Prior Publication Data

US 2018/0089963 A1 Mar. 29, 2018

(51) Int. Cl.
*G07F 19/00* (2006.01)

(52) U.S. Cl.
CPC ..... *G07F 19/204* (2013.01); *G07F 19/201* (2013.01)

(58) Field of Classification Search
USPC ..... 235/379
See application file for complete search history.

(56) References Cited

U.S. PATENT DOCUMENTS

| | | | |
|---|---|---|---|
| 2,912,066 | A | 11/1959 | Ellithorpe |
| 3,703,864 | A | 11/1972 | Bradford |
| 3,946,206 | A | 3/1976 | Darjany |
| 4,372,225 | A | 2/1983 | Tissot et al. |
| 4,557,352 | A | 12/1985 | Tschappat, Jr. |
| 4,953,326 | A | 9/1990 | Wexler et al. |
| 4,968,873 | A | 11/1990 | Dethloff et al. |
| 5,168,354 | A | 12/1992 | Martinez et al. |

(Continued)

FOREIGN PATENT DOCUMENTS

| | | |
|---|---|---|
| DE | 102009028991 | 8/2009 |
| EP | 0827066 | 7/1997 |
| WO | WO2013131153 | 4/2012 |

OTHER PUBLICATIONS

Conor Gaffey, "World's Smallest Nano Chip will Double Processing Power of Smartphones," Jun. 9, 2015.

(Continued)

*Primary Examiner* — Rafferty Kelly
(74) *Attorney, Agent, or Firm* — Weiss & Arons LLP; Michael A. Springs, Esq.

(57) ABSTRACT

Aspects of the invention relate to an OLED bank teller carrel with an integrated QST. The bank teller carrel may include a user-facing counter. The bank teller carrel may include an OLED screen embedded in the counter. The OLED screen may include an array of OLEDs. The array of OLEDs may be configured to display information. The OLED screen may include a software chip. The software chip may include a processor and a memory. The OLED screen may include touch screen capabilities. The touch screen capabilities may be configured to receive user input via human touch. The OLED screen may include biometric characteristic receipt film. The biometric characteristic receipt film may be configured to capture at least one biometric characteristic of a customer. The OLED screen may include a communication circuit. The communication circuit may configured to receive information from information hubs and transmit information to information hubs.

21 Claims, 10 Drawing Sheets

(56) References Cited

U.S. PATENT DOCUMENTS

| | | | | |
|---|---|---|---|---|
| 5,313,051 | A | 5/1994 | Brigida et al. | |
| 5,539,819 | A | 7/1996 | Sonoyama et al. | |
| 5,693,956 | A | 12/1997 | Shi et al. | |
| 5,734,154 | A | 3/1998 | Jachimowicz et al. | |
| 5,770,849 | A | 6/1998 | Novis et al. | |
| 5,970,888 | A | 10/1999 | Sheppard | |
| 6,015,092 | A | 1/2000 | Postlewaite et al. | |
| 6,057,646 | A * | 5/2000 | Pieroth | G07F 19/20 315/149 |
| 6,173,899 | B1 | 1/2001 | Rozin | |
| 6,394,343 | B1 | 5/2002 | Berg et al. | |
| 6,724,103 | B2 | 4/2004 | Parrault | |
| 7,025,277 | B2 | 4/2006 | Forrest et al. | |
| 7,270,276 | B2 | 9/2007 | Vayssiere | |
| 7,357,315 | B2 | 4/2008 | Vergara et al. | |
| 7,360,682 | B2 | 4/2008 | Shane et al. | |
| 7,360,691 | B2 | 4/2008 | Takayama | |
| 7,523,856 | B2 | 4/2009 | Block et al. | |
| 7,588,183 | B2 | 9/2009 | Shane et al. | |
| 7,791,559 | B2 | 9/2010 | Piasecki | |
| 7,814,016 | B2 | 10/2010 | Pranger | |
| 7,856,116 | B2 | 12/2010 | Rodriguez et al. | |
| 7,940,159 | B2 | 5/2011 | Clemens et al. | |
| 7,992,789 | B2 | 8/2011 | Borracci | |
| 8,237,068 | B2 | 8/2012 | Szaikowski | |
| 8,276,823 | B2 | 10/2012 | Chen | |
| 8,282,007 | B1 | 10/2012 | Cloutier et al. | |
| 8,317,094 | B2 | 11/2012 | Lehman | |
| 8,378,932 | B2 | 2/2013 | Fein et al. | |
| 8,392,965 | B2 | 3/2013 | Carter et al. | |
| 8,413,893 | B2 | 4/2013 | Kim | |
| 8,471,782 | B2 | 6/2013 | Muklashy et al. | |
| 8,479,981 | B2 | 7/2013 | Carmichael et al. | |
| 8,399,889 | B2 | 9/2013 | Wu et al. | |
| 8,523,059 | B1 | 9/2013 | Mullen et al. | |
| 8,540,151 | B1 | 9/2013 | Snyder et al. | |
| 8,678,293 | B2 | 3/2014 | Chen | |
| 8,756,680 | B2 | 6/2014 | Shashidhar | |
| 8,810,816 | B2 | 8/2014 | Fischer et al. | |
| 8,820,638 | B1 | 9/2014 | Cotter et al. | |
| 9,491,879 | B2 | 11/2016 | Cheng et al. | |
| 9,538,127 | B2 | 1/2017 | Gish | |
| 10,056,048 | B2 | 8/2018 | Kim | |
| 2001/0007332 | A1 | 7/2001 | Kjonaas et al. | |
| 2003/0145205 | A1 | 7/2003 | Sarcanin | |
| 2003/0208405 | A1 | 11/2003 | Putman et al. | |
| 2005/0064936 | A1 * | 3/2005 | Pryor | A63F 3/00643 463/36 |
| 2005/0102499 | A1 | 5/2005 | Kosuga et al. | |
| 2005/0134461 | A1 | 6/2005 | Gelbman et al. | |
| 2005/0173518 | A1 | 8/2005 | Takayama | |
| 2005/0263590 | A1 | 12/2005 | Branck et al. | |
| 2006/0016884 | A1 * | 1/2006 | Block | G06K 19/08 235/381 |
| 2006/0091223 | A1 | 5/2006 | Zellner et al. | |
| 2006/0131393 | A1 | 6/2006 | Cok et al. | |
| 2006/0261174 | A1 | 11/2006 | Zenner et al. | |
| 2006/0289629 | A1 | 12/2006 | Smith et al. | |
| 2007/0115202 | A1 | 5/2007 | Kiesenhofer | |
| 2007/0273507 | A1 | 11/2007 | Burchell et al. | |
| 2007/0279315 | A1 | 12/2007 | Laves et al. | |
| 2008/0035736 | A1 | 2/2008 | Tompkin et al. | |
| 2008/0105751 | A1 | 5/2008 | Landau | |
| 2008/0158150 | A1 | 7/2008 | Rossman et al. | |
| 2009/0039154 | A1 | 2/2009 | Williams et al. | |
| 2009/0278452 | A1 | 11/2009 | Kim | |
| 2009/0314840 | A1 | 12/2009 | Granucci et al. | |
| 2010/0084476 | A1 | 4/2010 | Zellner et al. | |
| 2010/0260388 | A1 | 10/2010 | Garrett et al. | |
| 2010/0302206 | A1 | 12/2010 | Yu et al. | |
| 2011/0058113 | A1 | 3/2011 | Threlkel et al. | |
| 2011/0060640 | A1 | 3/2011 | Thompson et al. | |
| 2011/0140841 | A1 | 6/2011 | Bona et al. | |
| 2011/0148944 | A1 | 6/2011 | Kobayashi | |
| 2011/0164047 | A1 | 7/2011 | Pance | |
| 2011/0178928 | A1 | 7/2011 | Carmichael et al. | |
| 2011/0241996 | A1 | 10/2011 | Vesely | |
| 2012/0019434 | A1 | 1/2012 | Kuhlman et al. | |
| 2012/0280924 | A1 | 11/2012 | Kummer et al. | |
| 2013/0162594 | A1 | 6/2013 | Paulsen et al. | |
| 2013/0221112 | A1 | 8/2013 | Lai et al. | |
| 2013/0232082 | A1 | 9/2013 | Krawczewicz et al. | |
| 2013/0341394 | A1 | 12/2013 | Seo et al. | |
| 2014/0007002 | A1 | 1/2014 | Chang et al. | |
| 2014/0081729 | A1 | 3/2014 | Ocher | |
| 2014/0093144 | A1 | 4/2014 | Feekes | |
| 2014/0114861 | A1 | 4/2014 | Mages et al. | |
| 2014/0172700 | A1 | 6/2014 | Teuwen et al. | |
| 2014/0226275 | A1 | 8/2014 | Ko et al. | |
| 2014/0267960 | A1 | 9/2014 | Ward | |
| 2014/0291406 | A1 | 10/2014 | Ko | |
| 2014/0337957 | A1 | 11/2014 | Feekes | |
| 2014/0339315 | A1 | 11/2014 | Ko | |
| 2014/0353384 | A1 | 12/2014 | Hoegerl et al. | |
| 2014/0374494 | A1 | 12/2014 | Seo | |
| 2015/0069126 | A1 | 3/2015 | Leon | |
| 2015/0077646 | A1 | 3/2015 | Chen et al. | |
| 2015/0179025 | A1 | 6/2015 | Cowell | |
| 2015/0262052 | A1 | 9/2015 | Pahuja | |
| 2016/0004945 | A1 | 1/2016 | Wade | |
| 2016/0027391 | A1 | 1/2016 | Gibson et al. | |
| 2016/0054479 | A1 | 2/2016 | Ho et al. | |
| 2016/0085325 | A1 | 3/2016 | Lee et al. | |
| 2016/0098709 | A1 | 4/2016 | Johnson et al. | |
| 2016/0171461 | A1 | 6/2016 | Hoover et al. | |
| 2016/0210453 | A1 | 7/2016 | Seo et al. | |
| 2016/0224528 | A1 | 8/2016 | Trevarthen et al. | |
| 2016/0254336 | A1 | 9/2016 | Zhang et al. | |
| 2016/0307089 | A1 | 10/2016 | Wurmfeld et al. | |
| 2017/0103718 | A1 | 4/2017 | Miller | |
| 2017/0357979 | A1 | 12/2017 | Khurana et al. | |

OTHER PUBLICATIONS http://www.us.schott.com/innovation/ultrathinglass/, Retrieved on Sep. 14, 2016.

"Schott's Reliable and Strong Ultra-Thin Glass Features in Fingerprint Sensors in new Smartphones," Retrieved on Sep. 14, 2016.

Ron Martens, "The OLED Handbook, A Guide to OLED Technology, Industry & Market," 2015 Edition.

Bryce Kellogg, Vamsi Talla, Shyamnath Gollakota and Joshua R. Smith, "Passive Wi-Fi: Bringing Low Power to Wi-Fi Transmissions," Retrieved on May 11, 2016.

Ron Mertens, SecureCard—A New Secure Credit Card Technology, Utilizing an OLED Display, Nov. 21, 2006, Metalgrass Software.

John Wehr, "Card Size Specifications: When Does Card Size Matter?" Jan. 1, 2002.

Zachary Shahan, "Ultra-Thin-Solar-Cell Company Unstealths, Aims to Cut Cost of Solar Cells in Half!" Mar. 14, 2012, Sustainable Enterprises Media, Inc.

"ISO Magnetic Stripe Card Standards," Retrieved on Jul. 18, 2016.

"Coin Vs. Plastic: Which Credit Card Consolidation Tool is the Best?" Retrieved on Apr. 7, 2016, PayProTec.

"Tiny Batteries Could Revolutionize Green Energy," Retrieved on Apr. 5, 2016, National Geographic Society.

"Yubikey 4 & Yubikey 4 Nano," Retrieved on Apr. 7, 2016, Yubico.

"Magnetic Stripe Card Standards," Retrieved on Apr. 20, 2016, MagTek Inc., Seal Beach, California.

"A Power-Harvesting Pad-Less mm-sized 24/60GHz Passive Radio With On-Chip Antennas," Retrieved on Apr. 19, 2016, IEEE.

"Magnetic Stripe Card Recommendations," Retrieved on Apr. 20, 2016.

"Plastic Card Manufacturing Including Magnetic Stripe Tapelaying," Retrieved on Apr. 20, 2016.

Paul Buckley, "Flexible OLED Displays Target Volume Production in 2015," Feb. 5, 2015.

"MAX2837-2.3GHz to 2.7GHz Wireless Broadband RF Transceiver," Retrieved on May 30, 2016, Maxim Integrated.

"Ultrathin Rechargeable Lithium Polymer Batteries from PowerStream," Apr. 5, 2016, Lund Instrument Engineering, Inc.

(56) References Cited

OTHER PUBLICATIONS

Tom Abate, "Stanford Engineers Aim to Connect the World with Ant-Sized Radios," Sep. 9, 2014, Stanford University, Stanford California.
http://www.schott.com/advanced_optics/english/syn/advanced_optics/products/wafers-and-thin-glass/glass-wafer-and-substrates/ultra-thin-glass/index.html, Retrieved on May 30, 2016.
Jennifer Langston, "UW Engineers Achieve Wi-Fi at 10,000 Times Lower Power," Feb. 23, 2016.
Ron Mertens, New All-In-One Credit Card Concept, Oct. 29, 2009, Metalgrass Software.
"Wi-Fi," Apr. 12, 2016, Wikimedia Foundation, Inc.
"Ant-Sized IoT Radio," Retrieved on Jul. 18, 2016.
Nick Pino, "Samsung's Latest OLED Can be a Mirror, a Window, or a TV," Jun. 11, 2015, Future US, Inc., San Francisco, California.
"Pneumatic Tube," Mar. 11, 2016, Wikimedia Foundation, Inc.
"New Virtual Tellers," Retrieved on Jun. 6, 2016, Frontier Bank.
Dario Borghino, "High-Tech Light Shutter Could Help Turn Your Windows into LCD Displays," May 1, 2015, Gizmag.
L. Zhao et al. "Novel Method for Fabricating Flexible Active Matrix Organic Light Emitting Diode (AMOLED) Displays," Sep. 21, 2011, Hewlett-Packard Development Company, L.P.
Amar Toor, "LG Unveils Flexible Plastic E-paper Display, Aims for European Launch Next Month," Mar. 29, 2012.
Martyn Williams, "Samsung, LG Show Flexible OLED, E-Paper Screens," Nov. 10, 2010.
"Electronic Paper," Jun. 10, 2016, Wikimedia Foundation, Inc.
"E Ink," Jun. 8, 2016, Wikimedia Foundation, Inc.
"Ink Technology: Electrophoretic Ink, Explained," Retrieved on Jun. 20, 2016, E Ink Holdings, Inc.
"Are Toeprints Unique, Like Fingerprints?" Retrieved on Jun. 23, 2016.
Sampath Srinivas, Dirk Balfanz, Eric Tiffany, Alexi Czeskis, "Univeral 2$^{nd}$ Factor (U2F) Overview", May 14, 2016, FIDO Alliance.
"Sonavation Announces Fingerprint Imaging Through Smart Phone OLED Display," Feb. 22, 2016.
Dario Borghino, "Wearable Thermoelectric Generator Could Extend Your Smartwatch's Battery Life", Apr. 14, 2014, Gizmag.
"Inductive Charging", May 6, 2016, Wikimedia Foundation, Inc.
"Near Field Communication", Apr. 29, 2016, Wikimedia Foundation, Inc.
Sumi Das, "A Keyboard that Rises Up From Flat Touch Screens," Feb. 13, 2013.
Jessica Leber, "A Shape-Shifting Smartphone Touch Screen," Dec. 3, 2012.
Matthew Frankel, "Could This Be the Bank of the Future?" Nov. 9, 2014.
"Contactless Payment," Jul. 27, 2016, Wikimedia Foundation, Inc.
Zhiquin Chen, "Java Card Technology for Smart Cards: Architecture and Programmer's Guide," pp. 11-14, Copyright 2000, Sun Microsystems, Inc., Palo Alto, California.

* cited by examiner

ORGANIC LIGHT EMITTING DIODE ("OLED") DISPLAY WITH QUICK SERVICE TERMINAL ("QST") FUNCTIONALITY

FIELD OF TECHNOLOGY

This invention relates to organic light emitting diode ("OLED") displays. Specifically, this invention relates to OLED displays as they relate to quick service terminals ("QST").

BACKGROUND OF THE DISCLOSURE

Conventionally, QSTs have been deployed at bank teller counters. These QSTs provide customer identification services. In order to identify the customer, the QSTs typically require a user to swipe or insert his or her card and then enter a pin number. These QSTs are costly. Furthermore, these QSTs occupy valuable "real estate" on the teller counter. It would be desirable to incorporate the QST into the counter in order to preserve counter real estate and reduce the necessity for purchasing costly QST equipment.

SUMMARY OF THE DISCLOSURE

An OLED bank teller carrel is provided. The OLED bank teller carrel may include a user-facing counter. The OLED bank teller carrel may also include an OLED screen. The OLED screen may be integrated within the contours of the user-facing counter. The OLED screen may be placed on the user-facing counter. The OLED screen may be attached to the user-facing counter with an adhesive or other mechanical attachment device.

The OLED screen may include an array of OLEDs. The OLED screen may also include a communication circuit. The communication circuit may enable communication between an external entity and the OLED screen. The OLED screen may also include a software chip. The software chip may be configured to control the array of OLEDs and the communication circuit.

The OLED screen may also include a power source connection. The power source connection may be configured to power the array of OLEDs, the software chip and the communication circuit. The power source connection may be a cord. The cord may connect to an electrical outlet. The power source connection may be a contactless power source connection. The power source connection may connect to an independent power source. For example, the independent power source may be a solar panel. The independent power source may be a battery. The power source connection may connect to multiple kinds of power sources, for example, there may be solar panels inside the OLED screen and a power cord attached to the OLED screen. Connections to multiple power sources may enable the OLED screen to remain active during a failure of one of the connected power sources or power source connections.

The OLED bank teller carrel may also include a glass window. The glass window may include a front face. The glass window may also include a rear face. The glass window may also include at least one edge. The at least one edge may be proximal to the counter. The front face may be situated perpendicular to the counter. The back face may be situated opposite the front face.

The OLED screen may also include a biometric characteristic receipt film. The biometric characteristic receipt film may be configured to capture one or more of a user's biometric characteristics with or without the user's knowledge. The OLED screen may also include touch screen characteristics.

The communication circuit may be connected to a wired network. The communication circuit may be connected to a wireless network. The communication circuit may be configured to communicate with an EMV chip card through a first communication channel. The communication circuit may also be configured to communicate with a communication network through a second communication channel.

In some embodiments, the first communication channel is a contactless communication channel. In other embodiments, the first communication channel is a contact communication channel. A contact communication channel may be understood to be, for the purposes of this application, a communication channel where some physical contact is necessary to initiate contact. In some embodiments, the second communication channel is a contactless communication channel. In other embodiments, the second communication channel is a contact communication channel.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
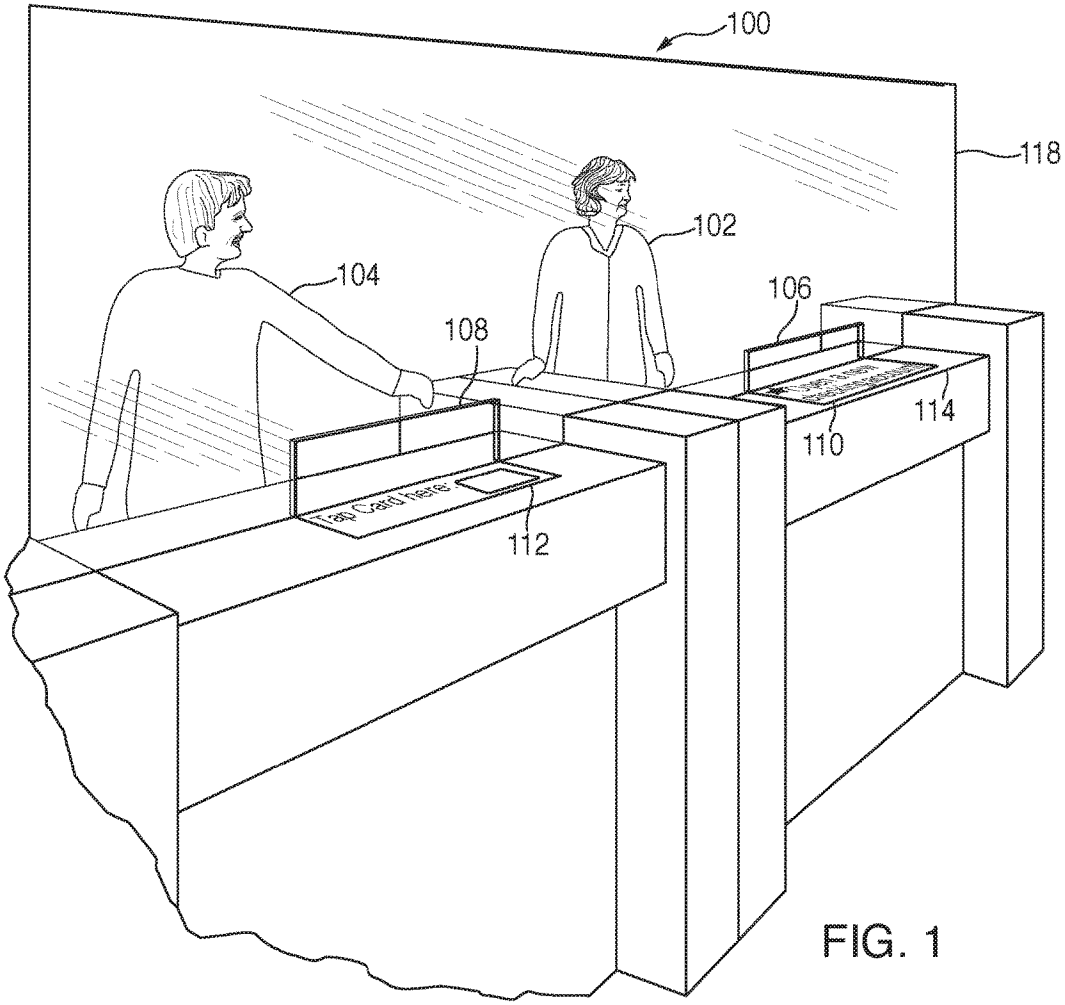
FIG. 1 shows a perspective view of illustrative bank teller carrels according to principles of the invention.

Methods for communicating information at a bank teller carrel may be provided. The methods may include receiving information from a smart card at an OLED screen. The OLED screen may be embedded in a counter of the bank teller carrel.

In some embodiments, an OLED glass counter may be manufactured. The manufactured OLED glass counter may replicate the shape of at least a portion of the bank teller counter. Manufacturing OLED glass counters that replicate portions of the bank teller carrel may enable manufacturing of OLED glass counters for pre-existing bank teller carrels.

The OLED screen may include an array of OLEDs. The OLED screen may include a connection to a power source.

The OLED screen may include a connection to a processor. The OLED screen may include a connection to a communication circuit. In certain embodiments, the power source, the processor and/or the communication circuit may be incorporated into the OLED screen.

The method may also include transmitting the received information to a teller processor. The transmission may utilize the connection to the power source. The transmission may be via the connection to the communication circuit. The transmission may also be via the connection to the processor. The teller processor may be associated with a bank teller.

The method may also include transmitting responsive information from the teller processor to the OLED screen. The responsive information may be transmitted in response to receiving information at the teller processor. In some embodiments, the responsive information may be self-initiated—i.e., not transmitted in response to any specific occurrence or event. The transmitting may utilize the connection to the power source. The transmission may be via the connection to the communication circuit. The transmission may also be via the connection to the processor.

The received information may be smart card information. The received information may be received from a contactless near field communication capture device. The contactless near field communication capture device may be located inside the OLED screen. The received information may be EMV chip card information.

Upon receipt of smart card information and/or EMV chip card information, the method may include displaying a pin pad to a user. The user may be able to enter his or her pin directly onto the OLED screen.

A bank teller carrel with a preferably integrated quick service terminal equipped with an OLED screen is provided. The OLED bank teller carrel may include a user-facing counter. The OLED bank teller carrel may include an OLED screen.

In some embodiments, the OLED screen may be affixed to the counter with an adhesive or other suitable mechanical attachment device. The OLED screen may also be placed in a slot in the counter. A slot in the counter may be defined as the space in between two, preferably flat, pieces of material, at least one of which is see-through. In some embodiments, more than two pieces of material may be used. A first piece of material may be placed on the second piece of material. The two pieces of material may be separated, preferably at the edges of at least one of the pieces of material, with an adhesive or other mechanical attachment device. The adhesive may preferably occupy space on the vertical axis—i.e., occupy some amount of height.

In some embodiments, a third piece of material may be used. In these embodiments, there may be a first, preferably flat, piece of material. A second piece of material may be placed on the first piece of material. The second piece of material may be a narrow piece of material. The second piece of material may be placed around a portion of the perimeter of the first piece of material. A third piece of material may be placed on top of the second piece of material. The third piece of material may be substantially similar to the first piece of material. The gap between the first piece of material and the third piece of material may form a slot. The slot between the first piece of material and the third piece of material may enable simple and easy "slide-in" placement of the OLED screen. In these embodiments, the third piece of material may preferably be glass or any other suitably transparent surface.

In some embodiments, the OLED screen may include a magnetic backing. In these embodiments, the counter may be magnetized to enable the OLED screen to magnetically adhere to the counter. In some embodiments, the magnetization of the counter may be electrically configured. In these embodiments, the counter may have the ability to be electrically magnetized or electrically de-magnetized. A bank teller may be able to magnetize the counter in order to maintain the location of the OLED screen. A teller may be able to de-magnetize the counter in order to remove the OLED screen.

In some embodiments, magnets may be positioned along the perimeter of the OLED screen. In some embodiments, magnets on the counter may be positioned along the perimeter of the location designated for the OLED screen. In some embodiments, when the magnets are positioned along the perimeter of the OLED screen and the entire counter is magnetized, the OLED screen may be placed at any suitable location on the counter.

In some embodiments, the magnetic backing of the OLED screen may also be electrically configured. Therefore, financial institution personnel may be able to magnetize the OLED screen in order to maintain the position of the OLED screen. Financial institution personnel may also be able to de-magnetize the OLED screen in order to remove the OLED screen from a specific location on the counter.

In some embodiments, the OLED screen may be portable—i.e., a standalone device that could be extended to the customer as necessary. In another embodiment, the OLED screen may be attached to an extendible arm. In these embodiments, the bank teller counter may be substantially empty when a customer enters a bank teller carrel. In the event that the customer is required to identify his or herself utilizing a QST or signature pad, the bank teller may hand, or extend, the portable OLED screen to the customer. The customer may swipe or tap his or her card on the portable OLED screen, enter privileged data onto to the portable OLED screen, sign the portable OLED screen and/or perform any other sort of operation necessary on the portable OLED screen. After the customer has completed all necessary activity on the OLED screen, the customer may hand, or extend, the portable OLED screen back to the bank teller. The bank teller may stow the OLED screen for another use.

In some embodiments, the OLED screen may also be used as a signature pad. A customer may sign the OLED screen to verify information. A customer may also sign the OLED screen for any other suitable reason. The signature may be electronically transmitted for storage at the financial institution.

In some embodiments, the OLED screen may be placed into an indentation on the counter. The indentation may match the size of the OLED screen.

In some embodiments, the QST may transmit information to the communication circuit. The information may be smart card information.

In some embodiments, a financial institution may transmit information to the communication circuit. In these embodiments, the information may be display information.

In some embodiments, the communication circuit may be configured to receive information from at least two information hubs. The communication circuit may also be configured to transmit information to the at least two hubs.

In some embodiments, one of the hubs may be a smart card. In some embodiments, one of the hubs may be a teller workstation. In some embodiments, one of the hubs may be a workstation.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is to be understood that other embodiments may be utilized and that structural, functional and procedural modifications may be made without departing from the scope and spirit of the present disclosure.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

FIG. 1 shows a perspective view of illustrative bank teller carrels 100. Bank tellers 102 and 104 may sit or stand behind bank teller window 118. Openings 106 and 108 may enable a customer to pass documents and/or information to bank tellers 102 and 104. Openings 106 and 108 may also enable bank tellers 102 and 104 to pass documents and/or information to a customer.

OLED screen 112 may be placed on, and/or integrated into counter 116. OLED screen 112 may instruct a customer to tap his or her card onto the OLED screen. A chip included in the customer's card may be received and/or read by the OLED screen. The OLED screen may transmit the card information to a processor associated with teller 104. Upon receipt and/or display of the information transmitted from the OLED screen, teller 104 may review the card information. Teller 104 and/or the processor may transmit instructions to the customer via a change in the display of the OLED screen. The customer may follow the instructions displayed on the OLED screen.

OLED screen 110 may be placed on counter 114. OLED screen 110 may display an advertisement. The advertisement may be displayed at specific times, for example, when a bank teller is not behind the counter or when a customer does not wish to perform any specific activity. At times, the OLED screen may change to a "tap card here" display upon detection of a card in the vicinity of the counter.

Figure 2:
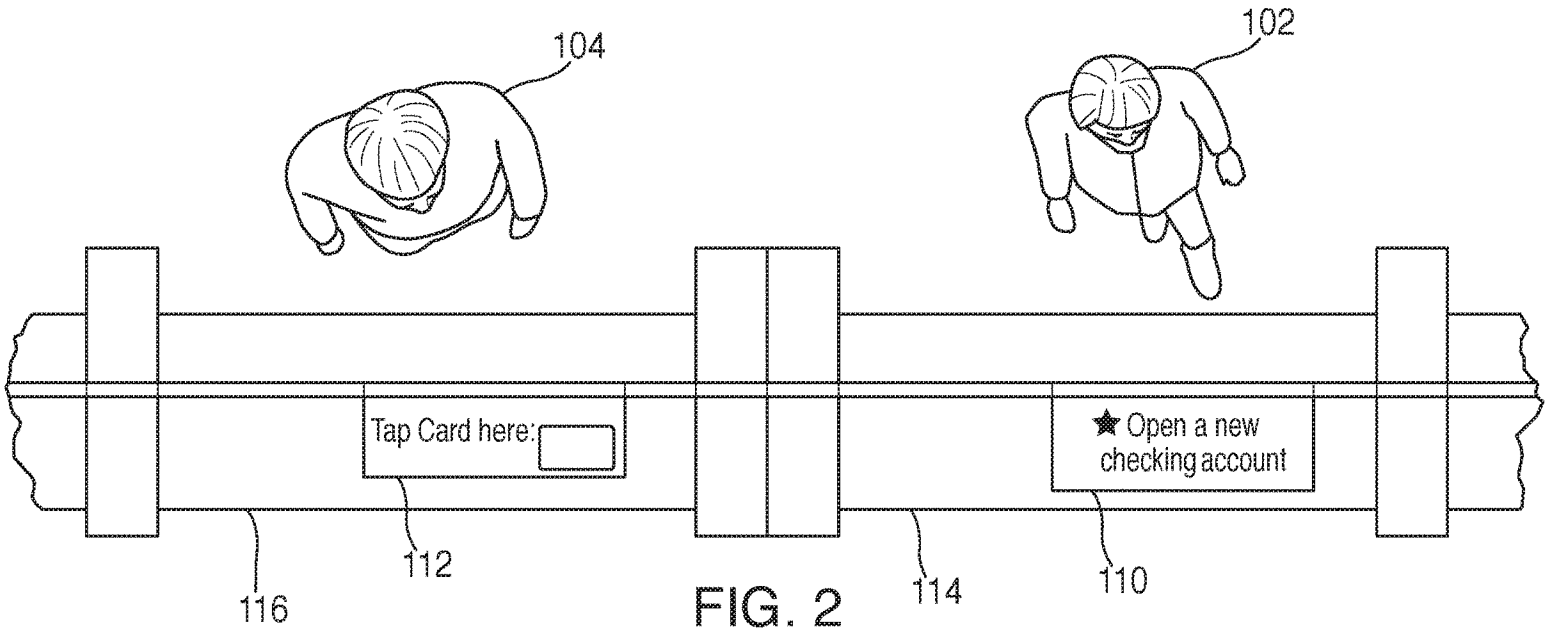
FIG. 2 shows a top view of illustrative bank teller carrels according to principles of the invention.

FIG. 2 shows a top view of bank teller carrels 100. It should be appreciated that OLED screens 110 and 112 do not occupy the entire space of counters 114 and 116. OLED screens 110 and 112 may be portable. OLED screens 110 and 112 may fit into a designated groove (not shown) on counters 114 and 116. OLED screens 110 and 112 may be magnetically adhered to counters 114 and 116. It should be appreciated that tellers 102 and 104 may control magnetism of OLED screens 110 and 112. Tellers 102 and 104 may also control the magnetism of counters 114 and 116. Tellers 102 and 104 may remove and demagnetize OLED displays 112 and 114 when not in use.

Figure 3:
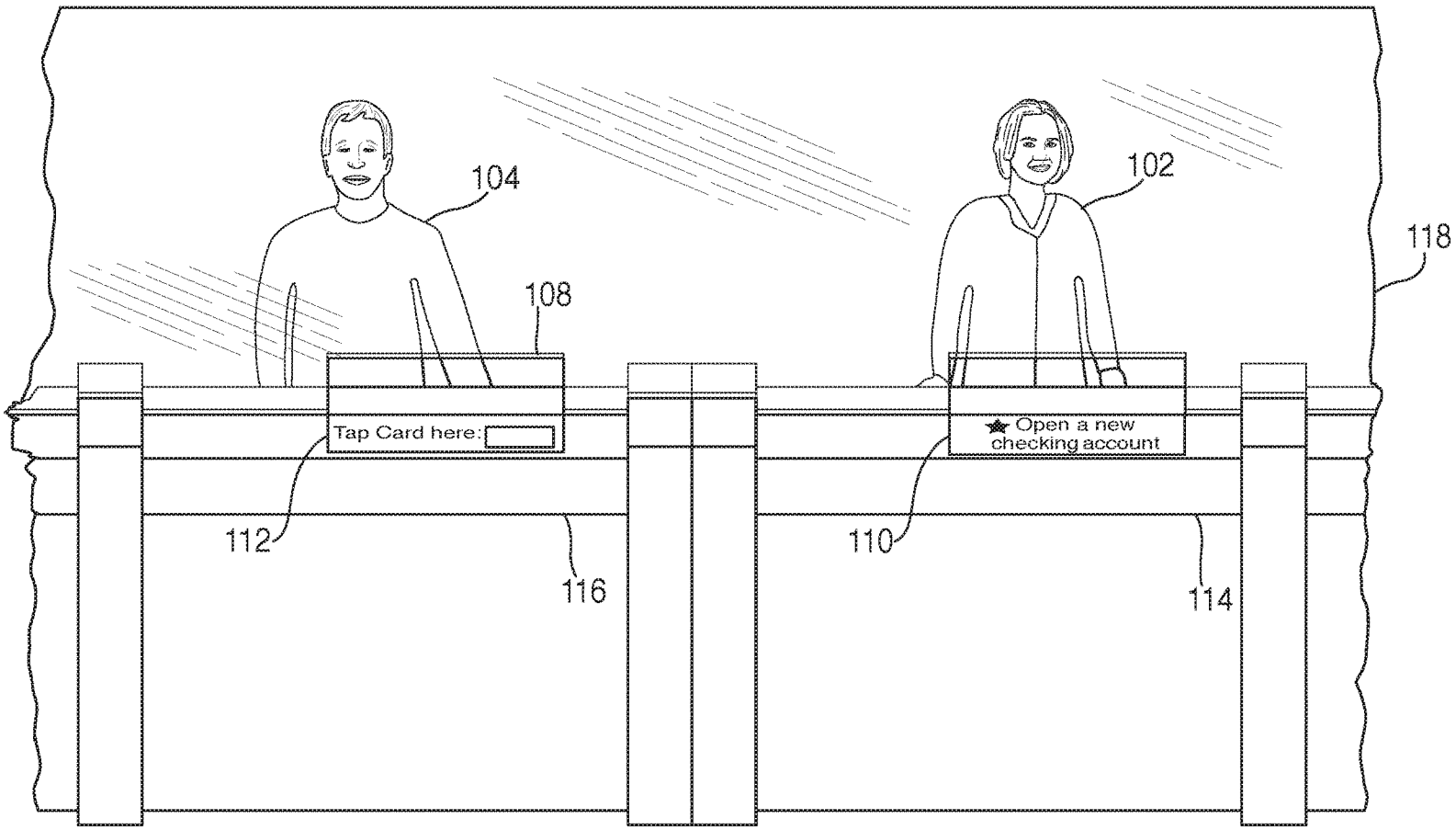
FIG. 3 shows a front view of illustrative bank teller carrels according to principles of the invention.

FIG. 3 shows a front view of illustrative bank teller carrels 100. Tellers 102 and 104 may sit or stand behind bank teller window 118. Openings 106 and 108 may enable a customer to pass documents and/or information to bank tellers 102 and 104. Openings 106 and 108 may also enable bank tellers 102 and 104 to pass documents and/or information to a customer. OLED screen 112 may sit on top of counter 116. OLED screen 112 may sit underneath a glass covering on top of counter 116. OLED screen 110 may sit on top of counter 114. OLED screen 110 may sit between two layers, at least one of which that may be a glass or other transparent material. OLED screen 110 may sit underneath a glass covering on top of counter 114.

Figure 4:
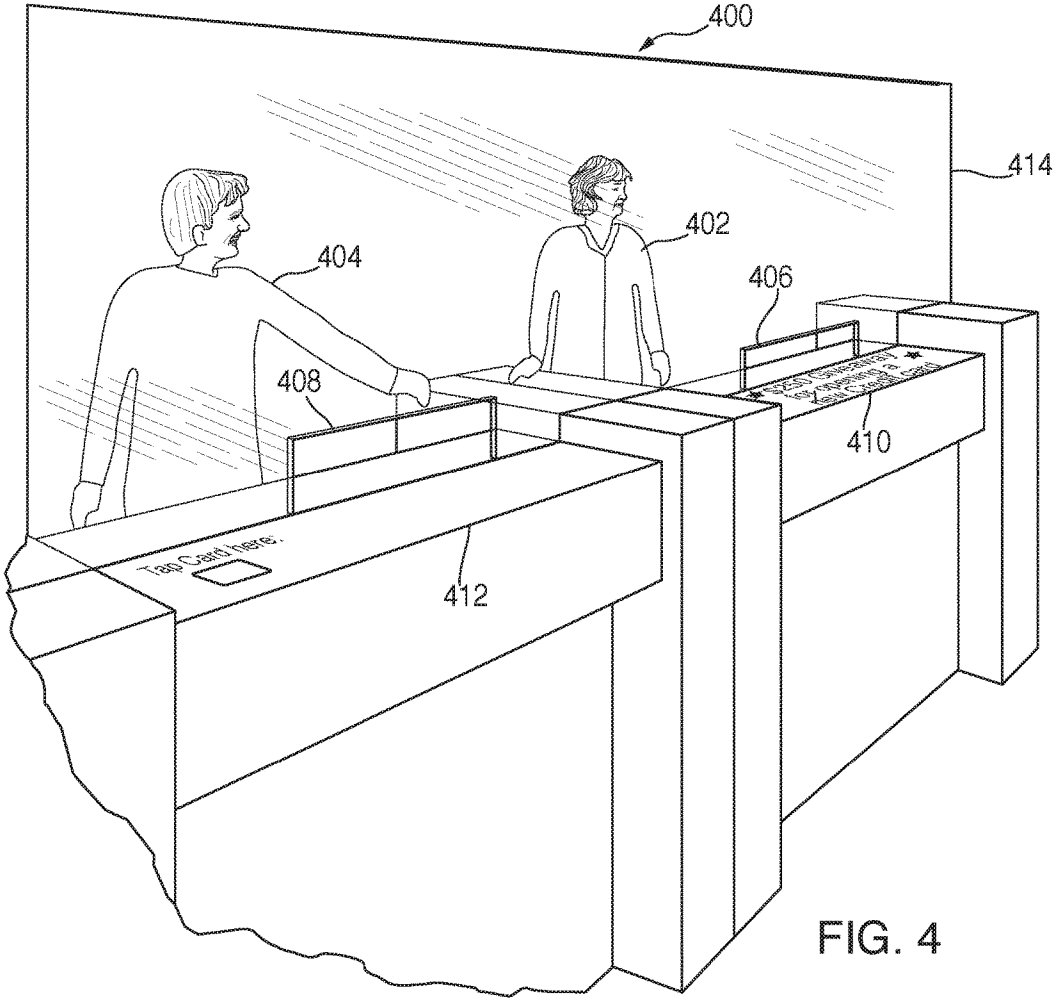
FIG. 4 shows another perspective view of illustrative bank teller carrels according to principles of the invention.

FIG. 4 shows a perspective view of illustrative bank teller carrels 400. Tellers 402 and 404 may sit or stand behind bank teller window 414. Openings 406 and 408 may enable a customer to pass documents and/or information to bank tellers 402 and 404. Openings 406 and 408 may also enable bank tellers 402 and 404 to pass documents and/or information to one or more customers. OLED screens 410 and 412 may replicate the shape of the counters on which they sit. A piece of material may sit on top of OLED screens 410 and 412. The piece of material may be glass or any other suitable transparent material. The piece of material may also replicate the shape of the counter beneath OLED screens 410 and 412. The piece of material may preferably enable touch screen capabilities of the OLED screen. Although the shape of the counter show in FIG. 4 is rectangular, it should be appreciated that the OLED screen and/or the piece of material may be manufactured in any suitable shape, for example, a triangle or octagon. The OLED screen may be shaped to conform to the shape of a counter.

Figure 5:
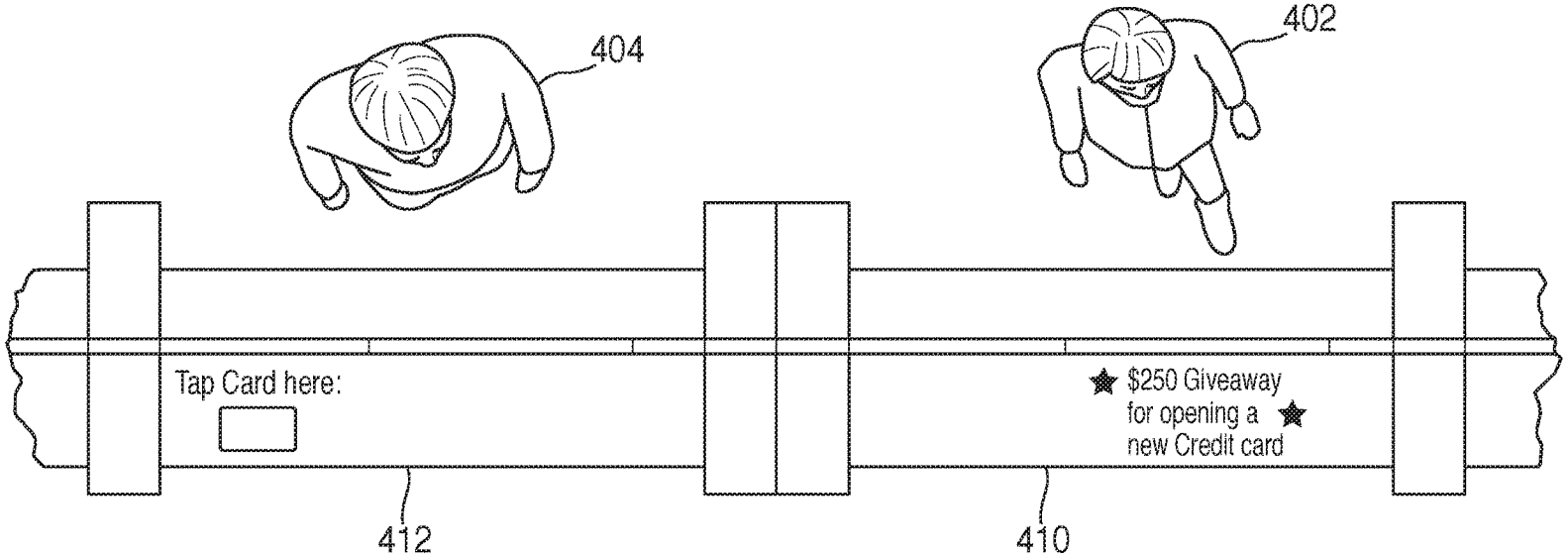
FIG. 5 shows another top of illustrative bank teller carrels according to principles of the invention.

FIG. 5 shows a top view of illustrative bank teller carrels 400. OLED screen 410 may be associated with bank teller 402. OLED screen 412 may be associated with bank teller 404. OLED screen 410 displays an advertisement to a customer. OLED screen 412 instructs a customer to tap his or card on a designated section of OLED screen 412.

Figure 6:
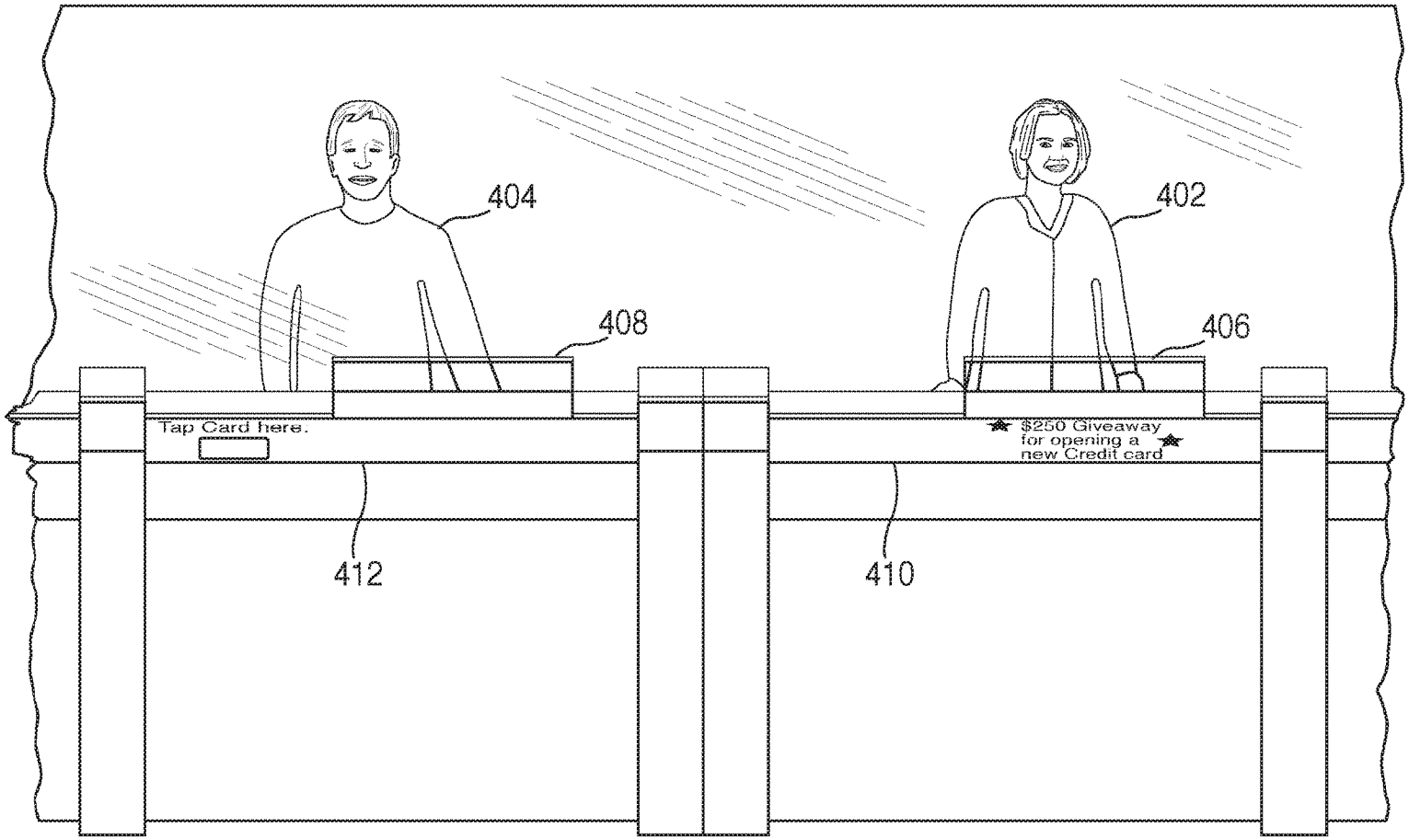
FIG. 6 shows another front view of illustrative bank teller carrels according to principles of the invention.

FIG. 6 shows a front view of illustrative bank teller carrels 400. Openings 406 and 408 may enable a customer to pass documents and/or information to bank tellers 402 and 404. Openings 406 and 408 may enable a customer to receive documents and/or information from bank tellers 402 and 404.

OLED screens 410 and 412 may be shown in a front view. In some embodiments, OLED screens 410 and 412 may sit on top of a counter with an angle. Therefore, OLED screens 410 and 412 may be angled. The angled counter and screen may enable a customer to better view OLED screens 410 and 412. The angled counter and screen may also enable a customer to easily write on the screen.

Figure 7:
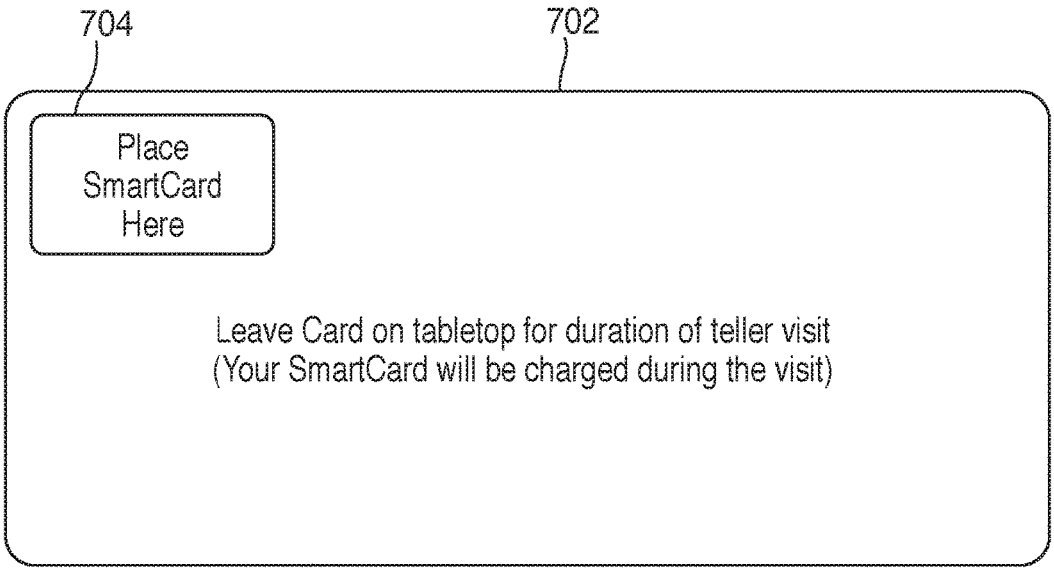
FIG. 7 shows a top view of an OLED screen according to principles of the invention.

FIG. 7 shows OLED screen 702. OLED screen 702 may instruct a customer to leave his or her card on the tabletop for the duration of the teller visit. OLED screen 702 may also instruct the customer that the card will be charged during the visit. Some cards may require electrical power to perform some or all of their functions. These cards may include power charge retrieval capabilities. OLED screen 702 may include power charge providing capabilities. When a card is placed on top of designated card section 704, the card may be charged with power. A customer may appreciate that his or her card is being charged during his time at the bank teller carrel.

Figure 8:
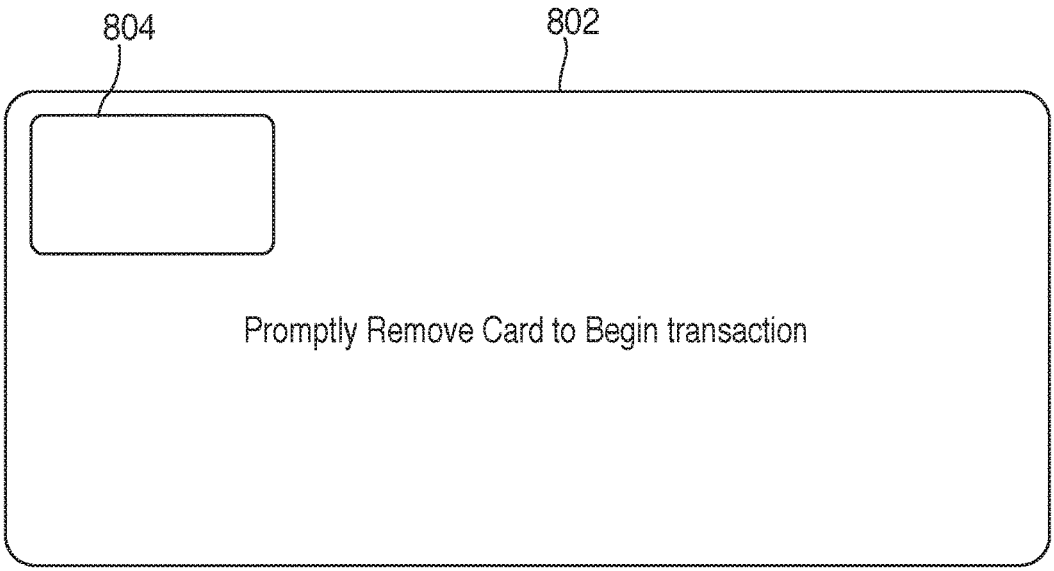
FIG. 8 shows another top view of an OLED screen according to principles of the invention.

FIG. 8 shows OLED screen 802. OLED screen 802 may instruct a customer to remove a card placed on designated card section 804. Removal of the placed card may enable the customer to initiate a transaction. The embodiment shown in FIG. 8 may include the benefit of making certain that the customer does not leave the card on OLED screen 802 upon completion of the processing the transaction.

Figure 9:
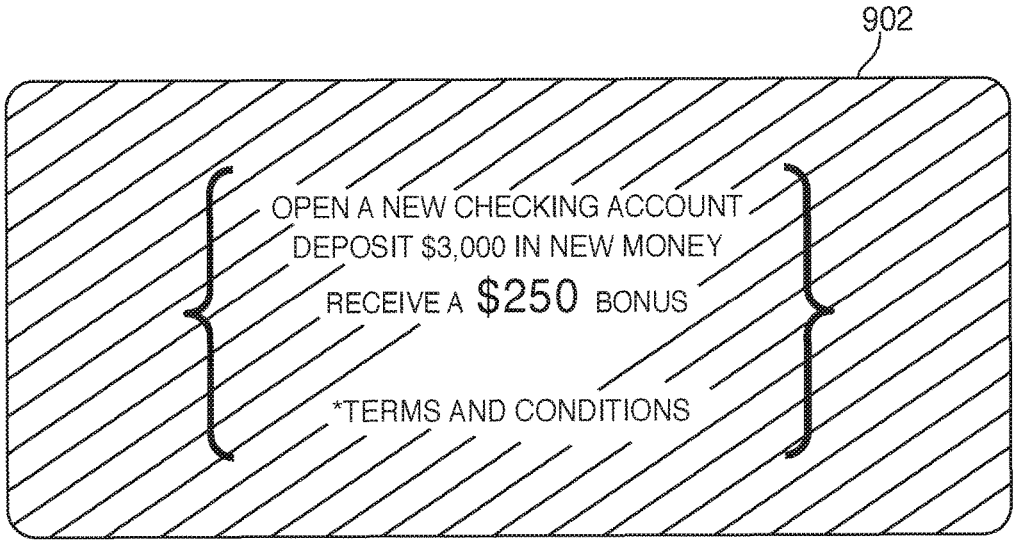
FIG. 9 shows yet another top view of an OLED screen according to principles of the invention.

FIG. 9 shows OLED screen 902. OLED screen 902 may display an advertisement. The advertisement may inform customers of a cash bonus associated with opening a new checking account.

Figure 10A:
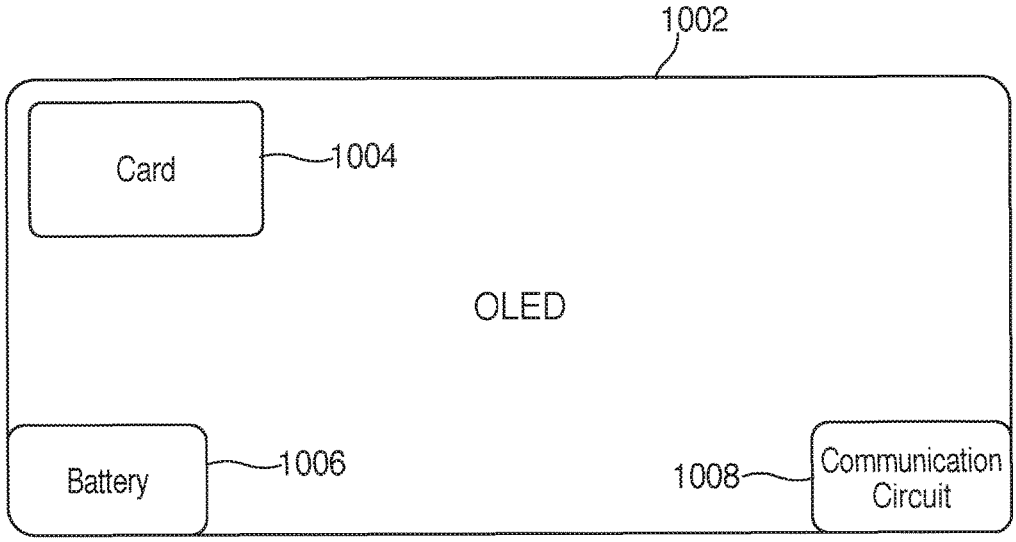
FIGS. 10A-C show layered views of an OLED screen according to principles of the invention.
Figure 10B:
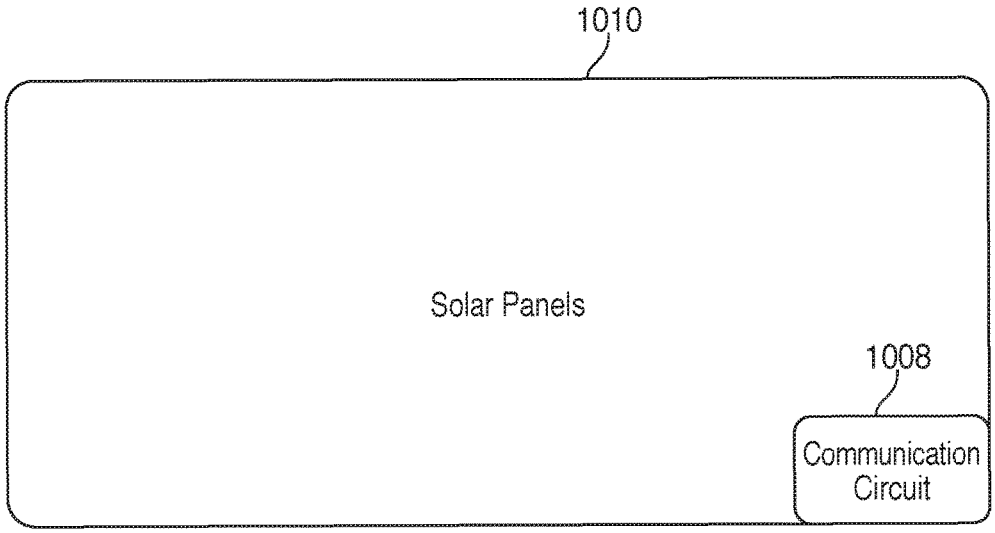
Figure 10C:
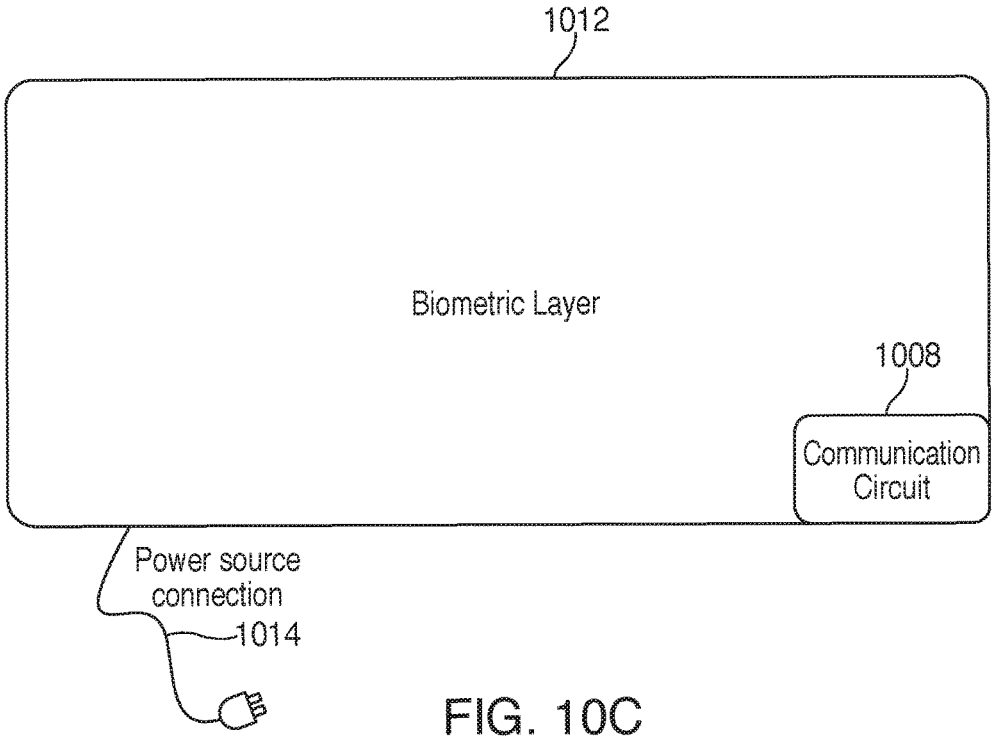

FIGS. 10A-C show illustrative layers that may be present within an OLED screen. FIG. 10A shows a first layer of an OLED screen. The first layer may include array of OLEDs 1002.

In some embodiments, the OLED screen may include a touch sensor (not shown). The touch sensor may be not greater than 0.001 mm thick. In some embodiments, the touch sensor may be embedded within the OLED screen. Integrating the touch sensor into the OLED screen may reduce reflectivity due to any space between the touch sensor the top of the OLED screen. Reducing reflectivity may increase visibility of information displayed on the OLED screen.

Using an OLED screen to display information may have several technical advantages. OLED displays may provide lower power consumption, wider viewing angles, better colors, higher contrast, operate in a wider temperature ranges and enable faster refresh rates than other display technology. In some embodiments, the OLED display may be fabricated directly on control circuitry. The OLED display may only include trace amounts of heavy metals. Thus, when disposed of, OLED displays may be less harmful to the environment than other display technology.

The first layer may also include battery 1006. Battery 1006 may be rechargeable. Battery 1006 may be flexible. Battery 1006 may be recharged by power generated by solar panels (shown in FIG. 10B). Battery 1006 may be rechargeable from a power source external to the OLED screen.

The OLED screen may include a processor circuit—i.e., a software chip (not shown). The processor circuit may control overall operation of the OLED screen and its associated components. The processor circuit may include a non-transitory memory. The OLED screen may include non-transitory memory locations (not shown) within the thickness of the OLED screen. The processor circuit may access such memory locations. The non-transitory memory locations may store instructions, that when executed by the processor circuit, cause the OLED screen to perform various functions.

For example, memory locations may store software used by the OLED screen, such as an operating systems, application programs and an associated database.

The first layer may also include card placement section 1004. It should be appreciated that card placement section 1004 may be dynamically positioned—i.e., the software chip may determine the position of card placement section 1004 for each display. The determination may be made based on convenience, "real estate" of the OLED display or any other suitable reason.

FIG. 10A shows that, in some embodiments, communication circuit 1008 may penetrate the first layer. Communication circuit 1008 may provide the OLED display with wireless communication functionality. Communication circuit 1008 may enable the OLED display to communicate using a variety of communication protocols, including, Wi-Fi, Bluetooth, Ethernet, NFC and cellular communications.

FIG. 10B shows a second layer of an OLED screen. The second layer may include solar panels. OLED displays may be transparent when not illuminated. Thus, when the OLED screen is not illuminated, it may be transparent. Sunlight or artificial light may pass through the array of OLEDs and reach solar panels 1010. Solar panels 1010 may convert solar energy into electricity that may power one or more of the components of the OLED screen. Solar panels 1010 may be thin enough to be flexible. FIG. 10B shows that, in certain embodiments, communication circuit 1008 may penetrate the second layer.

FIG. 10C shows a third layer of an OLED screen. The third layer may include biometric layer 1012. Biometric layer 1012 may be configured to retrieve biometric characteristic information. Biometric data may be retrieved from a human fingerprint, human iris, human voice or any other suitable biometric characteristic. In some embodiments, the biometric characteristic may be captured from biometric layer or film 1012 without a user's knowledge. The captured biometric characteristic may be verified prior to allowing the user to initiate a transaction. Verifying a user's biometric characteristics prior may assist in fraud prevention.

The third layer may also include power source connection 1014. Power source connection may connect the OLED screen to a power source. In some embodiments, the OLED screen may include both battery 1006 and power source connection 1014. In other embodiments, the OLED screen may include either battery 1006 or power source connection 1014.

Figure 11:
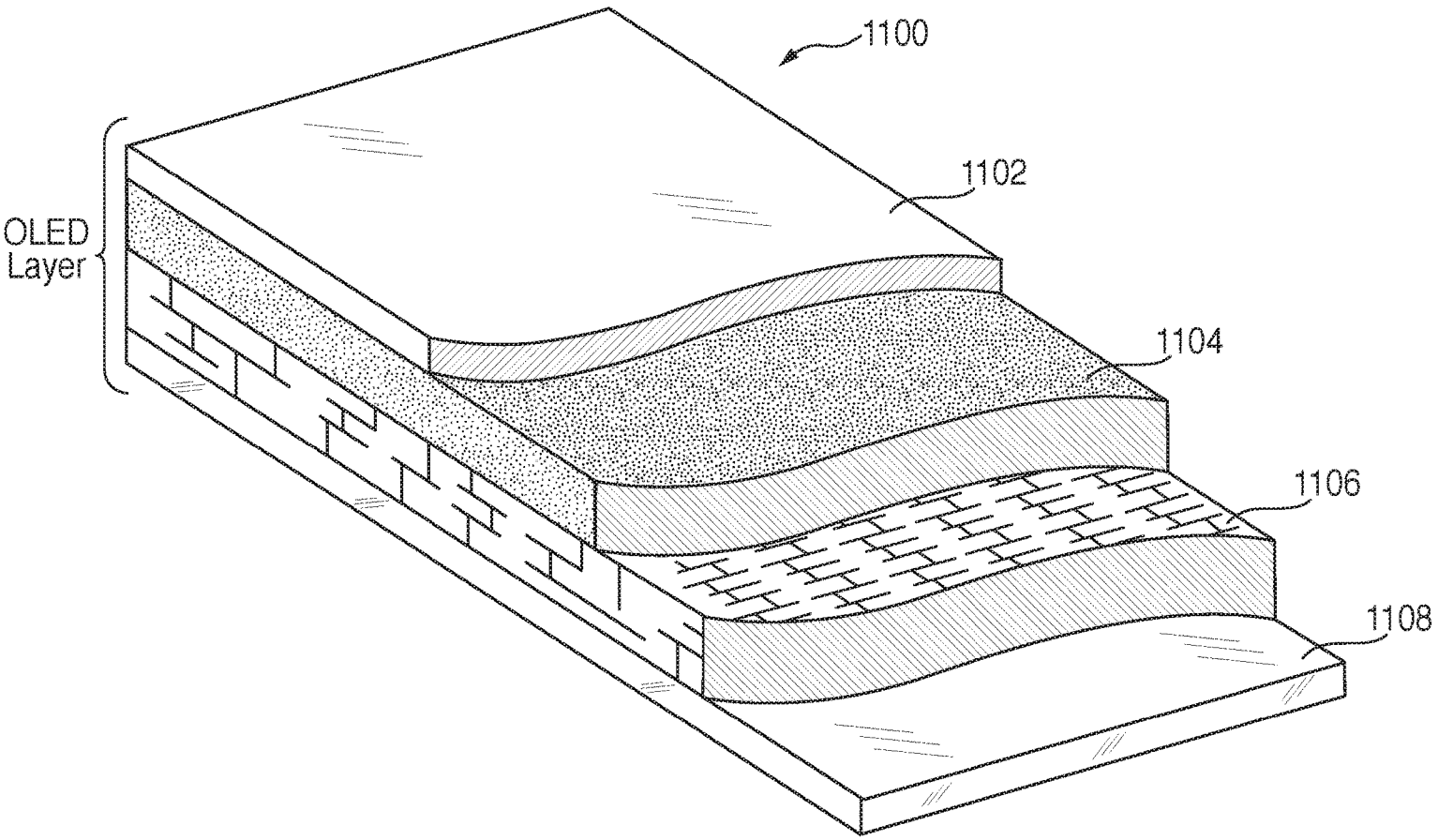
FIG. 11 shows a cutaway view of structures of an illustrative OLED layer.

FIG. 11 shows structures 1100 of an illustrative OLED layer. Structures 1100 include four layers: encapsulation layer 1102, organic layer 1104, circuitry layer 1106 and substrate layer 1108.

Encapsulation layer 1102 protects the OLED layer from exposure to oxygen, water and other contaminants. Preferably, encapsulation layer 1102 is flexible and transparent. Glass is a typical material for constructing encapsulation layer 1102. When glass is used to construct encapsulation layer 1102, the glass may be very thin and flexible. For example, the glass may be between 50 micrometers (μm) and 100 μm thick.

In some embodiments, encapsulation layer 1102 may be constructed using thin-film encapsulation techniques such as Atomic Layer Deposition ("ALD"). ALD is a process that utilizes chemicals that, when deposited on a material, react to create a solid, thin film.

Structures 1100 include organic layer 1104.

Organic layer 1104 typically includes an emissive solid-state semiconductor. Organic layer 1104 may be constructed from a thin film of organic (carbon-based) material. For example, organic layer 1104 may include one or more OLEDs. When electricity is applied to an OLED within organic layer 1104, electrons flow through organic layer 1104 and release photons, thereby emitting light. Different types of emissive materials may be used. Each type of material may be associated with a different color light. An intensity of light emitted by organic layer 1104 may be controlled by the amount of electricity flowing through organic layer 1104.

Organic layer 1104 may be doped with "host" materials. Host material may affect properties, such as power efficiency, of organic layer 1104. For example, organic layer 1104 may be doped with emitter materials that improve its operation and/or achieve a desired color.

Organic layer 1104 may include two or more sub-layers (not shown). For example, organic layer 1104 may include 5, or 15 sublayers. Illustrative sub-layers may include: (1) an electron transport layer, (2) a blocking layer, (3) an emissive layer, (4) a hole transport layer and (5) an injection layer. The sub-layers may enhance an efficiency of the emissive layer.

For example, an emissive layer may be placed between a cathode and an anode. When electricity is applied, electrons flow from the cathode to the anode. OLED displays may be driven by either electrical current or voltage. In a preferred embodiment, the OLED display is driven by current. The cathode inserts electrons into the emissive layer, and the anode removes the electrons. The electron "flow" through the emissive layer releases photons, generating light. The color of the generated light may be changed by including different types of materials within the emissive layer.

A direction of light emitted by the organic layer may be controlled by a degree of transparency of the anode and/or cathode. In some embodiments, a cathode may be reflective. Such a cathode may be constructing using an aluminum based-compound or lithium fluoride. An anode may be transparent. A transparent anode may preferably be constructed using indium tin oxide. In such embodiments, when current flows between the cathode and anode, light is emitted through circuitry layer 1106 and substrate 1108. Circuitry layer 1106 and substrate 1108 may be transparent. Such embodiments may be referred to as "bottom-emitting OLEDs."

In some embodiments, the cathode may be transparent. Such a cathode may preferably be constructed using indium tin oxide. The anode may be reflective. The reflective anode may direct light toward the transparent cathode. Such embodiments may be referred to as "top-emitting OLEDs." Typically, top-emitting designs are more efficient and are used to construct higher resolution displays.

Additionally, top-emitting designs may allow organic layer 1104 to be formed on a non-transparent substrate. Small- and medium-sized OLED displays (e.g., 1-7 inches) are typically constructed using top-emitting techniques.

Organic layer 1104 may form one or more pixels. Different architectures are available for forming pixels using OLEDs. One architecture includes positioning different color (e.g., red, green and blue) OLEDs adjacent to each other. Another architecture may include stacking different color OLEDs on top of each other. OLEDs may be stacked because materials used to construct organic layer 1104 may be transparent. A stacked design may provide a smaller pixel size and higher resolution.

Structures 1100 include circuitry layer 1106. Circuitry layer 1106 includes electronics that drive one or more pixels formed within organic layer 1104. Preferably, amorphous silicon ("a-Si") and low temperature polysilicon ("LTPS") may be used to construct circuitry layer 1106. In some embodiments, circuitry layer 1106 may be transparent.

Substrate layer 1108 supports circuitry layer 1106, organic layer 1104 and encapsulation layer 1102. Substrate layer 1102 may be constructed using various materials. For example, substrate layer 1108 may be constructed using glass, plastic or metal materials. In some embodiments, such as in bottom-emitting OLEDs, substrate layer 1108 may function as encapsulation layer 1102.

Thus, methods and apparatus for an OLED display with QST functionality have been provided. Persons skilled in the art will appreciate that the present invention can be practiced by other than the described embodiments, which are presented for purposes of illustration rather than of limitation. The present invention is limited only by the claims that follow.

What is claimed is:

1. An Organic Light Emitting Diode ("OLED") bank teller carrel comprising:
- a user-facing, horizontally-disposed counter;
- an OLED screen that replicates the shape of at least a portion of the counter, said OLED screen comprising:
  - an array of OLEDs, said array of OLEDs comprising:
    - an encapsulation layer constructed from glass between 50 and 100 micrometers thick;
    - an organic layer;
    - a circuitry layer; and
    - a substrate layer;
  - a communication circuit;
  - a touch sensor not greater than 0.001 millimeter;
  - a software chip configured to control the array of OLEDs and the communication circuit; and
  - a power source connection configured to power the array of OLEDs, the software chip and the communication circuit;
- a glass window comprising:
  - a front face;
  - a rear face; and
  - at least one edge; and
- wherein:
  - the at least one edge is proximal to the counter;
  - the front face is situated perpendicular to the counter; and
  - the back face is situated in the rear of the front face;
- wherein the OLED screen is operable to:
  - detect a card in p predetermined vicinity of the counter;
  - instruct a card user to tap a card in a designated section of the OLED screen;
  - read card data from a chip included in the card; and
  - transmit the card data to a processor.

2. The OLED bank teller carrel of claim 1, wherein the OLED screen further comprises a biometric characteristic receipt film.

3. The OLED bank teller carrel of claim 2, wherein the biometric characteristic receipt film is configured to capture a user's biometrics with or without the user's knowledge.

4. The OLED bank teller carrel of claim 1, wherein the OLED screen further comprises touch screen characteristics.

5. The OLED bank teller carrel of claim 1, wherein the communication circuit is connected to a wired network.

6. The OLED bank teller carrel of claim 1, wherein the communication circuit is connected to a wireless network.

7. The OLED bank teller carrel of claim 1, wherein the communication circuit is configured to:
- communicate with an EMV chip card through a first communication channel; and
- communicate with a communication network through a second communication channel.

8. The OLED bank teller carrel of claim 7, wherein the first communication channel is a contactless communication channel.

9. The OLED bank teller carrel of claim 1, wherein the power source connection connects to an independent power source.

10. The OLED bank teller carrel of claim 1, wherein the power source connection is a cord which connects to an electrical outlet.

11. The OLED bank teller carrel of claim 1, wherein the OLED screen is mechanically affixed to an extendible arm.

12. A method for communicating information at a bank teller carrel, the method comprising:
- detecting a smart card at an organic light emitting diode ("OLED") screen embedded in a horizontally-disposed counter of the bank teller carrel, the OLED screen comprising:
  - an array of OLEDs, said array of OLEDs comprising:
    - an encapsulation layer constructed from glass, said layer being between 50 and 100 micrometers thick;
    - an organic layer;
    - a circuitry layer; and
    - a substrate layer;

a touch sensor not greater than 0.001 millimeter;
a connection to a power source;
a connection to a processor, and
a connection to a communication circuit;
instructing a card user to tap the card in a designated section of the OLED screen;
receiving card information from a chip included in the card;
transmitting the received information to a teller processor associated with a bank teller;
wherein transmitting the received information:
utilizes the connection to the power source;
is executed via the connection to the communication circuit; and
is executed via the connection to the processor;
transmitting responsive information from the teller processor to the OLED screen;
wherein transmitting the responsive information:
utilizes the connection to the power source;
is executed via the connection to the communication circuit; and
is executed via the connection to the processor.

13. The method of claim 12, wherein the received information is smart card information.

14. The method of claim 13, wherein the received information is received from a contactless near field communication capture device within the OLED screen.

15. The method of claim 12, wherein the received information is EMV chip card information.

16. The method of claim 12, wherein the connection to the power source connects to an independent power source.

17. An organic light emitting diode ("OLED") bank teller carrel with an integrated quick service terminal ("QST") comprising:
a user-facing, horizontally-disposed counter;
an OLED screen embedded in the counter, the OLED screen comprising:
an array of OLEDs configured to display information, said array of OLEDs comprising:
an encapsulation layer constructed from glass between 50 and 100 micrometers thick;
an organic layer;
a circuitry layer; and
a substrate layer;
a software chip comprising a processor and a memory;
a touch sensor not greater than 0.001 millimeter, said touch sensor configured to provide touch screen capabilities, said touch screen capabilities configured to receive user input via human touch;
biometric characteristic receipt film configured to capture at least one biometric characteristic of a customer; and
a communication circuit configured to:
receive information from at least two information hubs; and
transmit information to the at least two hubs;
a battery configured to power the OLED screen, the software chip, the touch screen capability, the biometric receipt film and the communication circuit;
a glass window comprising:
a front face;
a rear face; and
at least one edge;
wherein:
the at least one edge is proximal to the counter;
the front face is situated perpendicular to the counter; and
the back face is situated in the rear of the front face
wherein the OLED screen is operable to:
detect a card in a predetermined vicinity of the counter;
instruct a card user to tap a card in a designated section of the OLED screen;
read card data from a chip included in the card; and
transmit the card data to a teller processor.

18. The OLED bank teller carrel with an integrated QST of claim 17, wherein one of the at least two hubs is the smart card and one of the at least two hubs is a teller workstation.

19. The OLED bank teller carrel with an integrated QST of claim 18, wherein the information transmitted to the communication circuit from the QST comprises smart card information.

20. The OLED bank teller carrel with an integrated QST of claim 19, wherein the information transmitted from the financial institution to the communication circuit includes display information.

21. The OLED bank teller carrel of claim 17, wherein one of the at least two hubs is a workstation.

* * * * *